US012727639B2

(12) United States Patent
Dean

(10) Patent No.: US 12,727,639 B2
(45) Date of Patent: Sep. 8, 2026

(54) FOOTWEAR

(71) Applicant: Martin William Fredrick Dean, Hertfordshire (GB)

(72) Inventor: Martin William Fredrick Dean, Hertfordshire (GB)

( * ) Notice: Subject to any disclaimer, the term of this patent is extended or adjusted under 35 U.S.C. 154(b) by 43 days.

(21) Appl. No.: 18/564,776

(22) PCT Filed: May 26, 2022

(86) PCT No.: PCT/EP2022/064359
§ 371 (c)(1),
(2) Date: Nov. 28, 2023

(87) PCT Pub. No.: WO2022/248640
PCT Pub. Date: Dec. 1, 2022

(65) Prior Publication Data

US 2024/0251907 A1 Aug. 1, 2024

(30) Foreign Application Priority Data

May 28, 2021 (GB) ..... 2107649

(51) Int. Cl.
*A43B 11/00* (2006.01)
*A43C 11/00* (2006.01)

(52) U.S. Cl.
CPC ..... *A43B 11/00* (2013.01); *A43C 11/00* (2013.01)

(58) Field of Classification Search
CPC .. A43B 11/00; A43B 3/16; A43B 3/30; A43C 11/002; A43C 11/004; A43C 11/00
See application file for complete search history.

(56) References Cited

U.S. PATENT DOCUMENTS 611,266 A * 9/1898 Morse ..... A43B 23/047 36/51
1,686,175 A 10/1928 Read
1,902,053 A * 3/1933 Zide ..... A43C 11/002 36/51

(Continued)

FOREIGN PATENT DOCUMENTS

CN 201888319 7/2011
CN 106418894 2/2017

(Continued)

OTHER PUBLICATIONS

International Search Report and Written Opinion for PCT/EP2022/064359, completed Aug. 12, 2022.

(Continued)

*Primary Examiner* — Katharine G Kane
(74) *Attorney, Agent, or Firm* — Wissing Miller LLP

(57) ABSTRACT

The disclosure relates to a footwear collar and an item of footwear comprising the collar for defining an opening into which a wearer's foot is insertable, the collar comprising a one-piece semi-rigid element which borders the opening, by itself or in combination with a sole or an upper of the footwear, to continuously surround the opening, and an undulating configuration comprising a first series of alternating peaks and troughs, the peaks being located adjacent the opening, wherein the collar is biased into a closed configuration and can be moved into an open configuration in which the size of the opening is increased to don and doff the footwear.

20 Claims, 9 Drawing Sheets

(56) References Cited

U.S. PATENT DOCUMENTS

| | | | | |
|---|---|---|---|---|
| 2,487,227 | A * | 11/1949 | Eberle | A43B 9/02 36/16 |
| 2,770,055 | A * | 11/1956 | Hayden | A43B 1/04 36/51 |
| 3,568,338 | A | 3/1971 | Nadler | |
| 4,154,009 | A | 5/1979 | Kubelka | |
| 5,152,082 | A | 10/1992 | Culpepper | |
| 5,377,430 | A | 1/1995 | Hatfield | |
| 5,806,208 | A * | 9/1998 | French | A43B 7/146 36/28 |
| 5,950,335 | A | 9/1999 | Okajima | |
| 6,298,582 | B1 | 10/2001 | Friton | |
| 8,677,652 | B2 * | 3/2014 | Marvin | A43B 13/203 36/50.1 |
| 10,638,810 | B1 | 5/2020 | Cheney | |
| 10,660,401 | B1 | 5/2020 | Pratt | |
| 2002/0038522 | A1 | 4/2002 | Houser | |
| 2002/0066123 | A1 | 5/2002 | Jaworski et al. | |
| 2002/0174568 | A1 | 11/2002 | Neiley | |
| 2003/0145484 | A1 * | 8/2003 | Chen | A43B 3/02 36/3 R |
| 2003/0159312 | A1 * | 8/2003 | Farys | A43B 5/08 36/51 |
| 2005/0081404 | A1 | 4/2005 | Hurd | |
| 2007/0011910 | A1 | 1/2007 | Keen | |
| 2007/0277394 | A1 | 12/2007 | Hansen et al. | |
| 2010/0229429 | A1 | 9/2010 | Longuet | |
| 2011/0030125 | A1 | 2/2011 | Shinga | |
| 2012/0011744 | A1 * | 1/2012 | Bell | A43B 23/0245 36/91 |
| 2012/0180338 | A1 * | 7/2012 | Lin | A43B 9/02 36/56 |
| 2013/0104422 | A1 | 5/2013 | Hatfield | |
| 2014/0259760 | A1 | 9/2014 | Dojan et al. | |
| 2014/0360048 | A1 | 12/2014 | DeHaven | |
| 2015/0026937 | A1 | 1/2015 | Nonogawa | |
| 2016/0213096 | A1 | 7/2016 | Borel | |
| 2017/0099908 | A1 * | 4/2017 | Lee | B29D 35/0063 |
| 2017/0303632 | A1 | 10/2017 | Pratt | |
| 2017/0360141 | A1 * | 12/2017 | Azoulay | A43B 11/00 |
| 2017/0360155 | A1 * | 12/2017 | Leary | A43B 23/081 |
| 2018/0020774 | A1 | 1/2018 | Chang | |
| 2018/0110287 | A1 | 4/2018 | Hopkins | |
| 2018/0110292 | A1 * | 4/2018 | Beers | A43B 11/02 |
| 2019/0110557 | A1 * | 4/2019 | Hobson | D03D 15/56 |
| 2020/0015543 | A1 | 1/2020 | Roser | |
| 2020/0025333 | A1 | 1/2020 | Orlitzky | |
| 2024/0237785 | A1 * | 7/2024 | Mazzarolo | A43C 1/003 |

FOREIGN PATENT DOCUMENTS

| | | |
|---|---|---|
| EP | 1059044 | 12/2000 |
| EP | 2438826 | 4/2012 |
| ES | 1048120 | 6/2001 |
| ES | 1064644 | 4/2007 |
| ES | 1068404 | 5/2009 |
| GB | 2607093 | 11/2022 |
| KR | 860004257 | 5/1986 |
| KR | 20090021479 | 4/2009 |
| KR | 20110083188 | 7/2011 |
| KR | 20140102419 | 8/2014 |
| KR | 20070102995 | 10/2017 |
| WO | 2007143228 | 12/2007 |
| WO | 2009014433 | 1/2009 |
| WO | 2012168956 | 12/2012 |
| WO | 2013064925 | 5/2013 |
| WO | 2014041228 | 3/2014 |
| WO | 2022248640 | 1/2022 |

OTHER PUBLICATIONS

International Preliminary Report on Patentability in PCT/EP2022/064359, mailed Dec. 7, 2023.

International Search Report in PCT/EP2022/064359, mailed Aug. 12, 2022.

* cited by examiner

FOOTWEAR

This application is a 371 of PCT/EP2022/064359, filed on May 26, 2022, published on Dec. 1, 2022, under publication number WO 2022/248640, which claims priority benefits from Great Britain Patent Application No. 2107649.2, filed on May 28, 2021, the disclosure of each of which are incorporated herein by reference.

TECHNICAL FIELD

The invention relates to footwear. In particular, the invention relates to a footwear collar and an item of footwear comprising the collar.

BACKGROUND

There are various ways to don and doff footwear. People are leading increasingly busy lives and it can be inconvenient and time consuming to don and doff footwear. For example, some footwear requires a wearer to bend down to don and/or doff the footwear, for example using laces to tighten and loosen the footwear to ensure a good fit. This bending action is difficult for some wearers due to, for example, age or health reasons and is time consuming and inconvenient. There is a need for a footwear that is easy to don and doff in a convenient and quick manner without requiring the wearer to bend down. Further there is a preference to provide people with more choice in terms of fit, style or fashion of footwear.

SUMMARY OF THE INVENTION

According to a first aspect there is provided an item of footwear comprising a collar for defining an opening into which a wearer's foot is insertable the collar comprising a one-piece semi-rigid element which borders the opening, by itself or in combination with a sole or an upper of the footwear, to continuously surround the opening, and an undulating configuration comprising a first series of alternating peaks and troughs, the peaks being located adjacent the opening, wherein the collar is biased into a closed configuration and can be moved into an open configuration in which the size of the opening is increased to don and doff the footwear.

The collar has a simple yet functionally effective design being formed of a one-piece semi-rigid element. The collar is semi-rigid to the extent that it is biased into a closed configuration whilst maintaining an opening and being easily movable into an open configuration in which the size of the opening is increased or expanded when a wearer's foot is inserted into the opening and the wearer's foot exerts a force on the collar. The collar is semi-rigid such that it is stiff enough yet resilient to enable the collar to flex under the force exerted by a wearer's foot.

The collar may be a moulded element for ease of manufacture. The collar may be a three-dimensional moulded element. The collar may be formed of a material selected from one or more of: a plastics material; a foam; a rubberised latex; metal; and naturally occurring material. Example suitable plastics material may include nylon, thermoplastic polyurethane (TPU), polyvinyl chloride (PVC), and silicone polymer, or variations thereof. Example suitable foam material may include ethylene-vinyl acetate (EVA), and polyurethane. Example suitable naturally occurring material may include cork, resin, and leather such as thick-bend leather used to form a sole. The design and shape of the collar by way of the series of alternating peaks and troughs allows the collar to move between the open and closed configurations. The collar may be an elastic or semi-elastic material. The collar is durable, returning to the closed configuration through repeated use by a wearer donning and doffing the footwear.

The collar can be moved into an open configuration in which the size of the opening is increased. This allows the wearer to insert their foot through the opening to don and doff the footwear.

The item of footwear may comprise a sole and, optionally, an upper.

The collar defines an opening or mouth into which a wearer's foot is insertable. The collar borders or skirts the opening to define the opening by itself or in combination with a sole or an upper of the footwear, for example through 360 degrees of the opening, such that the collar continuously surrounds or defines the opening by itself or in combination with a part of the footwear. The collar may form a boundary of the opening or an edge along or beside the opening. The collar may delineate the opening to indicate the exact position of the opening. The collar may substantially surround and/or continuously surround the opening through 360 degrees of the opening. The item of footwear may have no elements obstructing the opening. Example of elements include fastenings, such as laces, buckles and hook and loop fastenings (Velcro™).

The undulating configuration comprises a first series of alternating peaks and troughs with the peaks being located adjacent the opening. The troughs may be located away from the opening and towards a sole of the footwear. When the footwear comprises an upper, the troughs may be located on the upper and/or on the sole of the footwear. The collar may comprise an undulating configuration which may comprise substantially one or more of: a waveform; a zig-zag; a sinusoid; a concertina shape; a coil shape; and fingers. The design or shape of the collar allows the collar to repeatedly flex and bend (effectively functioning to stretch or elasticate the collar) without deformation.

The foot has an instep which is the arched middle portion at the top of the foot, in front of the ankle joint. The footwear has a throat region which, when the wearer dons the footwear, is adjacent the instep of the foot.

The collar has an anatomical shape to conform to that of a wearer's foot when a user's foot is fully inserted into the footwear. In use, when the wearer's foot is fully inserted into the footwear, the collar passes over the foot's instep, such that the instep is adjacent the throat region of the footwear. In the embodiments described (with the exception of the slide-sandal embodiment), the collar encircles the ankle of the wearer's foot in 360 degrees passing around the entire foot through instep to heel and back to the instep. In the slide-sandal embodiment, the collar passes over the wearer's instep through substantially 180 degrees.

The collar may be configured so that a peak comes into contact with the instep of a wearer's foot to don and doff the footwear. The collar may be configured such that when a wearer inserts their foot into the opening the instep and/or heel of the foot may come into contact with a tongue section and heel section of the collar. The peaks and troughs of the collar may be symmetrical about a centre line passing from the tongue section to the heel section of the collar. A single peak may be provided at each of the tongue section and/or heel section of the collar, wherein the single peak may be broader or wider than the other peaks, for example broader than the peaks at lateral sections of the footwear. This helps to widen the opening of the collar as soon as the wearer positions their foot to don and doff the footwear. This configuration ensures that when a wearer inserts their foot into the opening of the collar the instep and/or heel of the foot may come into contact with a peak at the tongue section and at the heel section of the collar before it comes into contact with a trough of the collar.

The collar may comprise a first face and a second opposed face, the first face configured in use to be adjacent a wearer's foot, and wherein a thickness of the collar is defined between the first face and second opposed face. The thickness may vary at different positions of the collar. The varying thickness of the collar or semi-rigid element controls the extent to which different sections of the collar be moved between the closed and open configurations. Sections of the collar with a smaller thickness than other sections may move to a greater extent than the other sections with a larger thickness, and vice versa. This allows the fit of the footwear to be tailored for different wearers and foot sizes.

The collar may comprise a heel section and a tongue section with lateral sections therebetween, and wherein the collar is configured to move to an open configuration in response to force exerted on the heel section and/or a tongue section. The heel section is located at a heel region of the footwear. The tongue section is located at a tongue region of the footwear. The tongue section and heel section therefore align with the instep and heel of the wearer's foot, respectively. The instep can contact the tongue section of the collar, and/or the heel can contact the heel section of the collar, to exert a force on the collar and move the collar to an open configuration. In the open configuration the heel section and tongue section of the collar are moved further apart compared to the closed configuration.

The heel section and/or the tongue section may comprise a peak. This allows the force of a wearer's foot to be exerted on the peak to move the collar to the open configuration. This allows the collar to move more easily into the open configuration under the force exerted by the wearer's foot inserted into the opening making it easier for the wearer to don and doff the footwear.

The heel section and/or tongue section may comprise a flared portion that flares outwards away from the opening to thereby act as a shoehorn. This makes it easier for the wearer to don and doff the footwear since the flared section widens the opening to allow the wearer to insert their foot more easily into the opening.

The thickness of the collar may be greater at the heel section and/or the tongue section than the lateral sections. This helps the force exerted by the wearer's foot in the opening to be focused on the tongue section and/or heel section making it easier to don and doff the footwear.

The collar may comprise an upper edge and a lower edge, wherein the upper edge comprises the first series of alternating peaks and troughs. The lower edge may not comprise an undulating configuration (for example extending in a line around the footwear). Alternatively, the lower edge may comprise a second series of alternating peaks and troughs. The peaks of the lower edge may align with the peaks of the upper edge. The troughs of the lower edge may align with the troughs of the lower edge.

A distance between the upper edge and the lower edge may vary around the collar. This allows different parts of the collar to bend or flex by varying amounts to provide an improved fit for different wearers having different foot sizes (i.e., the collar flexes as opposed to deforming by crushing). The distance may be larger at the peaks and/or troughs than mid-sections between the peaks and troughs. This allows the movement of the collar into the open configuration to be concentrated at the mid-sections. This has the advantage that it encourages more flexing at the lateral regions as the collar moves from closed configuration to open configuration, resulting in the tongue and heel regions moving apart. In addition, it provides a more comfortable fit.

The undulating configuration may extend around the opening. The peaks and troughs may extend between the opening and a sole of the footwear.

The number of peaks and troughs may be the same such that the collar has symmetry along a longitudinal axis of the footwear extending from heel to toe. The total number of peaks and troughs may be six, eight, or twelve, or more or less. In its simplest form the collar may comprise two peaks and two troughs, such as one peak at the tongue section and one peak at the heel section with one trough therebetween at each lateral section (ankle section), such that the collar is V-shaped. The heel section and/or tongue section may each comprise a single peak and without a trough. The flared portion may be located on the single peak at the heel section and/or tongue section. This makes it easier for the wearer to don and doff the footwear since the peak comes into contact with the instep and/or heel first and before a trough when the wearer inserts their foot into the opening.

The undulating configuration may further comprise a second series of alternating peaks and troughs. This allows an easier movement of the collar into the open configuration. The lower edge may comprise the second series of alternating peaks and troughs.

The series of alternating peaks and troughs may correspond to multiple undulations of the undulating configuration, each undulation comprising a single peak and trough and having a varying length and/or amplitude around the collar. Further, an angle at the peaks and troughs may vary around the collar. This allows movement of the collar to be focused on different parts of the collar. The design or shape of the collar with the series of alternating peaks and troughs enhances the movement of the collar at the peaks when the troughs are attached to the footwear. A wider angle at the peaks and troughs has the potential to provide more movement of the collar. However, in practice, the troughs may be attached to the footwear, for example at a sole of the footwear, such that the troughs are anchored to restrict movement of the collar at the troughs. In this manner, more movement of the collar may be provided at the peaks compared to the troughs.

The movement of the collar may be focused on different parts of the collar by customizing the attachment of the collar to the footwear. For example, the troughs may be attached to the footwear at the lateral sections and not attached at the tongue section and heel section. This focusses movement of the collar to the tongue section and heel section compared to the lateral sections, thereby providing ankle support.

In an example, a collar having a larger number of peaks and troughs (with narrower angles at the peaks and troughs) is afforded a greater degree of movement or enhanced movement of the collar, compared to a collar having a lesser number of peaks and troughs (with wider angles at the peaks and troughs). This is due to the lesser number of troughs attached to the footwear actually increasing the restriction to movement of the collar in the trough regions.

In an example the undulating configuration is represented by a waveform wherein each undulation corresponds to one wave or period of the waveform. Each undulation therefore comprises a wavelength and amplitude. The length or wavelength defined as the distance along the collar between adjacent peaks or adjacent troughs. The amplitude defined as half the distance along the collar between an adjacent peak and trough from a position of equilibrium (above and below which the waveform oscillates or undulates).

The collar may be configured such that it is biased towards the closed configuration such that the collar in use grasps the wearer's foot, i.e., whilst the wearer is donning the footwear. This enables the wearer to don and doff the footwear without bending down to adjust or tighten a fit of the footwear.

The collar may comprise an adjustment means. This allows the wearer to adjust a fit of the collar and hence the footwear, allowing the wearer to adjust the tightness of the footwear around their foot. The wearer may initially use the adjustment means to adjust the fit of the footwear to their foot to provide a custom fit. Thereon, the wearer may leave the adjustment means in the custom position, such that the footwear remains custom fit to their foot-size from the first use and thereafter relying on properties of the collar to don and doff the footwear (via the size of the opening being increased under influence of a force exerted on the collar by the wearer's foot). The adjustment means may comprise apertures for receiving laces. The adjustment means may be integrally formed with the collar and may be formed of the same material as the collar. The integrally formed adjustment means may comprise integral loops and/or eyelets on the collar such that laces may be threaded therethrough. The adjustment means may be located on the tongue section of the collar, or closer to the tongue section than the heel section of the collar.

The footwear may comprise a collar-receiving means, configured such that the collar is removably attachable to the footwear. The collar may form a separate component to the footwear. This allows the collar to be removably attached or anchored to the footwear such that the collar can be provided as a modular component that is interchangeable for another collar, for example of a different colour, style, or fashion. The collar may be removably attached to an upper and/or sole of the footwear. The collar may be wrapped or pass underneath the footwear and/or be insertable into the sole of the footwear.

The collar-receiving means may comprise a recessed surface or grooves into which at least part of the collar is mounted in use and/or a pocket configured to receive a portion of the collar. The collar is biased to the closed configuration and the size of the opening on the collar may be increased to remove the collar from the recessed surface. This enables the collar to be removably attached to the footwear in a more secure manner. Further it helps to align the collar in a correct or preferred position on the footwear, for example to align the heel section and tongue section of the collar with the wearer's heel and instep, respectively. The collar therefore fits snugly into the recessed surface or cavity. The edges of the recessed surface may be embossed or comprise protrusions to further aid positioning of the collar on the footwear.

The pocket may be located on a tongue region and/or heel region of the footwear to ensure the collar remains in a correct or preferred position during use since a peak of the collar may extend into the pocket. This pocket makes it easier for the wearer to removably attach and detach the collar for interchanging the collar. The wearer's foot exerts a force on the collar at the heel section and tongue section of the collar and the pocket provides more stability to don and doff the footwear by restricting movement of the collar. The pocket may be permanently attached to the footwear to provide a more stable attachment of the collar to the footwear. The pocket may comprise an aperture, for example for receiving a fastening means of the collar or through which the fastening means is insertable. The pocket may be provided at any location on the footwear such that the collar can extend or slot into the pocket to restrict movement or twisting of the collar about the footwear and/or maintain an alignment of peaks at the heel section and/or tongue section.

Alternatively, the collar may be permanently bonded to the footwear, such as to the upper and/or sole of the footwear, to improve the strength and durability of the collar attachment to the footwear. The collar may be attached to the footwear via cementing and/or stitching.

The collar may comprise a first fastening means and the footwear may comprise a second fastening means, wherein the first and second fastening are configured to interact, in use, to fasten the collar to the footwear. The collar may comprise a third fastening means and the footwear may comprise a fourth fastening means, wherein the third and fourth fastening means are configured to interact, in use, to fasten the collar to the footwear. This allows the collar to be removably attached or anchored to the footwear in a more secure manner and to ensure a correct alignment of the collar, for example preventing twisting of the collar about the footwear during use. The fastening means reinforce the collar from collapsing in the regions of the collar that are subject to force from the wearer's foot when the wearer dons and doffs the footwear. The collar may be removably attached to an upper and/or sole of the footwear. The first fastening means may be located on a tongue section of the collar and the second fastening means may be located on a tongue region of the footwear. The third fastening means may be located on a heel section of the collar and the fourth fastening means may be located on a heel region of the footwear. This helps to align the collar in a correct or preferred orientation on the collar. The first and/or third fastening means may comprise a protrusion and the second and/or fourth fastening means may comprise an aperture configured to receive the protrusion. The protrusion may be a button and/or have a broad top and a narrow stem, for example in the shape of a mushroom. The mushroom-shaped protrusion allows part of the laces (for example) to be hidden beneath the protrusion.

The collar may surround substantially 180 degrees of the opening. The collar may comprise a toe-post to provide a more secure fit of the footwear. The toe-post may be integrally formed with the collar such that the toe-post is formed of the same material as the collar for ease of manufacture. The collar may be insertable into recesses in the sole of the footwear such that the collar (including the toe-post) may be reversibly attached to the sole, enabling the collar to be removed from the footwear and replaced.

According to a second aspect there is provided a footwear collar for defining an opening into which a wearer's foot is insertable, the collar comprising a one-piece semi-rigid element, configured such that in use it borders the opening of an item of footwear, by itself or in combination with a sole or an upper of a footwear, to continuously surround the opening, and an undulating configuration comprising a first series of alternating peaks and troughs, the peaks being located adjacent the opening, wherein the collar is biased into a closed configuration and can be moved into an open configuration in which the size of the opening is increased to don and doff a footwear. The collar may be interchangeable, for example for a collar of a different colour, style, or fashion.

The collar may comprise a heel section and a tongue section with lateral sections therebetween, and a first face and a second opposed face, the first face configured in use to be adjacent a wearer's foot, and wherein a thickness of the collar is defined between the first face and second opposed face, and wherein the thickness of the collar is greater at the heel section and/or the tongue section than the lateral sections. The varying thickness of the collar or semi-rigid element controls the extent to which different sections of the collar be moved between the closed and open configurations. Sections of the collar with a smaller thickness than other sections may move to a greater extent than the other sections with a larger thickness, and vice versa. This allows the fit of the footwear to be tailored for different wearers and foot sizes. It also helps the force exerted by the wearer's foot in the opening to be focused on the tongue section and/or heel section making it easier to don and doff the footwear.

The heel section and/or the tongue section may comprise a single peak. This allows an instep of a wearer's foot to come into contact with the single peak to don the footwear. This allows the force exerted by the foot on the collar to be applied at a focused part of the collar, thereby to aid expansion of the collar opening to don and doff the footwear. This configuration has the advantage that when a wearer inserts their foot into the opening the instep and/or heel of the foot may come into contact with a single peak before a trough.

The heel section and/or tongue section may comprise a flared portion that flares outwards away from the opening to thereby act as a shoehorn. This makes it easier for the wearer to insert their foot into the opening since the flared section widens the opening.

The collar may comprise an upper edge and a lower edge at which the first face and second opposed face meet, the upper edge comprising the first series of alternating peaks and troughs, wherein a distance between the upper edge and lower edge varies around the collar. This allows different parts of the collar to bend or flex by varying amounts to provide an improved fit for different wearers having different foot sizes. The distance may be larger at the peaks and/or troughs than mid-sections between the peaks and troughs. This allows the movement of the collar into the open configuration to be concentrated at the mid-sections providing a more comfortable fit.

The series of alternating peaks and troughs may correspond to multiple undulations of the undulating configuration, each undulation comprising a single peak and trough and having a length and amplitude, wherein the length and/or amplitude is not the same for every undulation. This allows movement of the collar to be focused on different parts of the collar.

The collar may comprise an adjustment means, optionally wherein the adjustment means comprises apertures for receiving laces. The adjustment means may be integrally formed with the collar such that the adjustment means is formed of the same material as the collar. This allows the wearer to adjust a fit of the collar, allowing the wearer to adjust the tightness of the collar around their foot. Laces may be threadable through the adjustment means. The adjustment means may be provided on the collar so as to be positioned symmetrically about a centre line running from the tongue section to the heel section.

The collar may comprise a first fastening means located on the tongue section of the collar. This allows the collar to be removably attached to the footwear in a more secure manner and to ensure a correct alignment of the collar, for example preventing twisting of the collar about the footwear during use. The collar may be removably attached to an upper and/or sole of the footwear. The first fastening means may comprise a protrusion configured to engage with a corresponding aperture on an item of footwear. The protrusion may be a button, such as a mushroom-shaped button which allows part of the laces (for example) to be hidden beneath the protrusion.

The collar may comprise a toe-post to provide a more secure fit of the footwear. The toe-post may be integrally formed with the collar such that the toe-post is formed of the same material as the collar for ease of manufacture. The collar may be insertable into recesses in the sole of the footwear such that the collar (including the toe-post) may be reversibly attached to the sole, enabling the collar to be removed from the footwear and replaced.

Throughout the description and claims of this specification, the words "comprise" and "contain" and variations of the words, for example "comprising" and "comprises", mean "including but not limited to", and do not exclude other components, integers, or steps. Moreover, the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Within the scope of this application, it is expressly intended that the various aspects, embodiments, examples, and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible.

BRIEF DESCRIPTION OF THE DRAWINGS

One or more embodiments of the invention will now be described, by way of example only, with reference to the accompanying drawings, in which.

DETAILED DESCRIPTION

Figure 1:
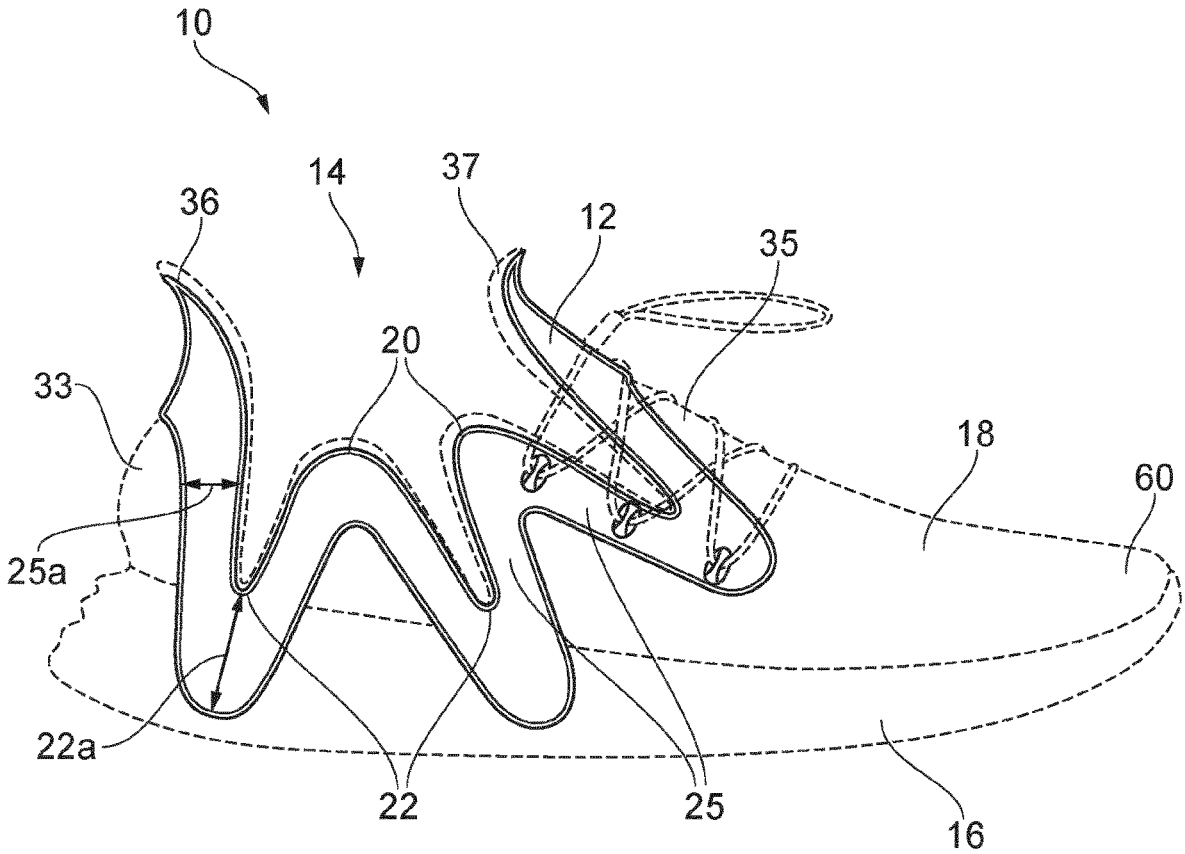
FIG. 1 is a schematic showing an item of footwear comprising a collar according to a shoe embodiment.

An item of footwear 10 according to a first embodiment is shown in FIG. 1. The item of footwear 10 is a shoe and comprises a sole 16, an upper 18 and an opening 14 into which a wearer's foot is insertable. The collar 12 surrounds the opening 14.

Figure 2A:
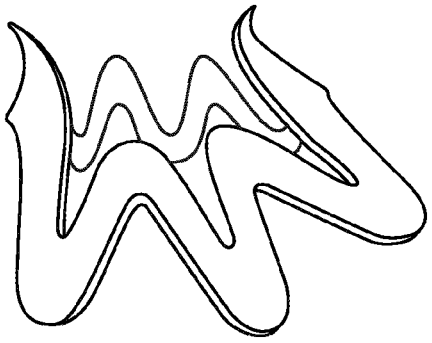
FIG. 2A is a schematic showing a collar for an item of footwear according to the shoe embodiment.
Figure 2B:
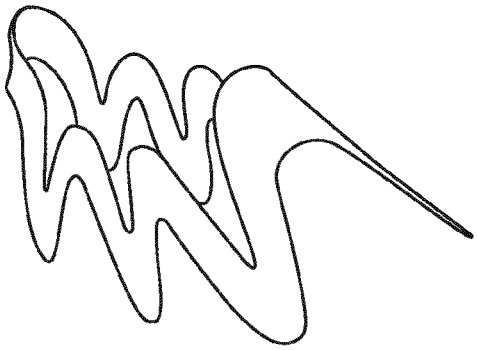
FIG. 2B is a schematic showing a collar for an item of footwear according to a three-quarter shoe embodiment.

The collar 12 comprises a one-piece semi-rigid element, for example as shown in FIGS. 2A and 2B. The collar 12 has an undulating configuration which enables the collar to flex, thereby adjusting the size of the opening.

Figure 3:
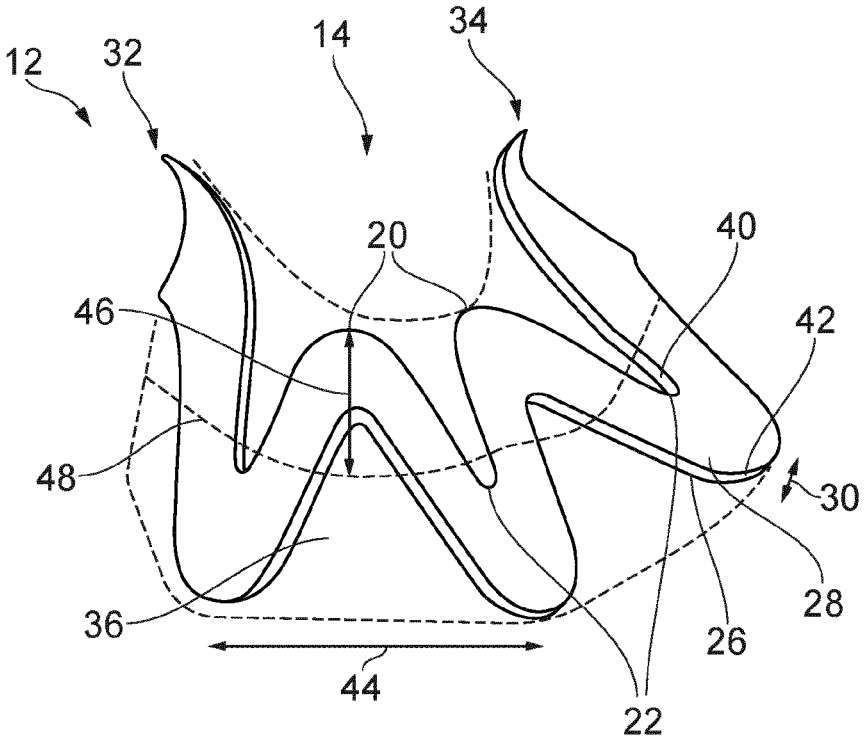
FIG. 3 is a schematic showing a collar for an item of footwear according to the shoe embodiment.

As shown in FIG. 3 the collar 12 comprises a first face 26 and a second opposed face 28. The first face 26 is configured in use to be adjacent a wearer's foot. The collar 12 also comprises an upper edge 40 and a lower edge 42 at which the first face 26 and second opposed face 28 meet. The upper edge 40 comprises a first series of alternating peaks 20 and troughs 22. In this embodiment, the lower edge 42 comprises a second series of alternating peaks 21 and troughs 23.

A thickness 30 of the collar 12 is defined between the first face 26 and second opposed face 28. The thickness 30 may vary in different regions of the collar 12. The regions of reduced thickness 30 allow more flexing than the regions of greater thickness.

The collar 12 comprises a heel section 32 and a tongue section 34 with lateral sections therebetween 36. As shown in FIG. 1, the heel section 32 is located at a heel region 33 of the footwear 10. The tongue section 34 is located at a tongue region 35 of the footwear 10. The thickness of the collar may be greater at the heel section 32 and/or the tongue section 34 than the lateral sections 36. These thicker regions at the heel section 32 and the tongue section 34 provide additional strength, as the tongue region and heel regions of the footwear 10 experience more force from a wearer's foot when donning and doffing the footwear.

A distance between the upper edge 40 and lower 42 edge may vary around the collar 12. As shown in FIG. 1, the distance 22*a* may be larger at the peaks 20 and/or troughs 22 than the distance 25*a* at mid-sections 25 between the peaks 20 and troughs 22. The variation in distance between the upper edge 40 and lower edge 42 effects the flexing of the collar 12, with more flexing occurring at the regions of reduced distance between the upper edge 40 and the lower edge 42.

The collar 12 borders the opening 14, such that the collar 12 continuously surrounds the opening 14 through 360 degrees. As shown in FIGS. 12A to 12D, the undulating configuration extends around the opening 14. The peaks 20 and troughs 22 extend between the opening 14 and the sole 16 of the footwear 10. The peaks 20 are located adjacent the opening 14 and the troughs 22 are located away from the opening 14 and towards the sole 16.

In the embodiment illustrated in FIG. 1, the footwear comprises an upper 18 and the troughs 22 are located on the upper 18 (in the tongue region) and on the sole 16 (in the lateral regions).

The collar 12 has an equal number of peaks 20 and troughs 22, giving the collar 12 symmetry about a longitudinal axis extending from the heel region 33 to a toe region 60 of the item of footwear 10. The collars 12 shown in FIGS. 2A and 2B have six peaks and six troughs.

The series of alternating peaks 20, 21 and troughs 22, 23 correspond to multiple undulations of the undulating configuration. Each undulation may comprise a single peak 20 and a single trough 22. Each undulation has a length 44 and amplitude 46, and these values may vary from undulation to undulation. The length 44 and amplitude 46 of each undulation is selected both for optimal fit of the collar 12 during use and to create the desired movement between open and closed configurations.

In an example, the undulating configuration is represented by a waveform, wherein each undulation corresponds to one wave or period of the waveform. Each undulation therefore comprises a wavelength 44 and amplitude 46, as shown in FIG. 3. The length 44 or wavelength is defined as the distance along the collar 12 between adjacent peaks 20 or adjacent troughs 22. The amplitude 46 is defined as half the distance along the collar 12 between an adjacent peak 20 and trough 22 from a position of equilibrium 48 (above and below which the waveform oscillates or undulates).

Figure 5:
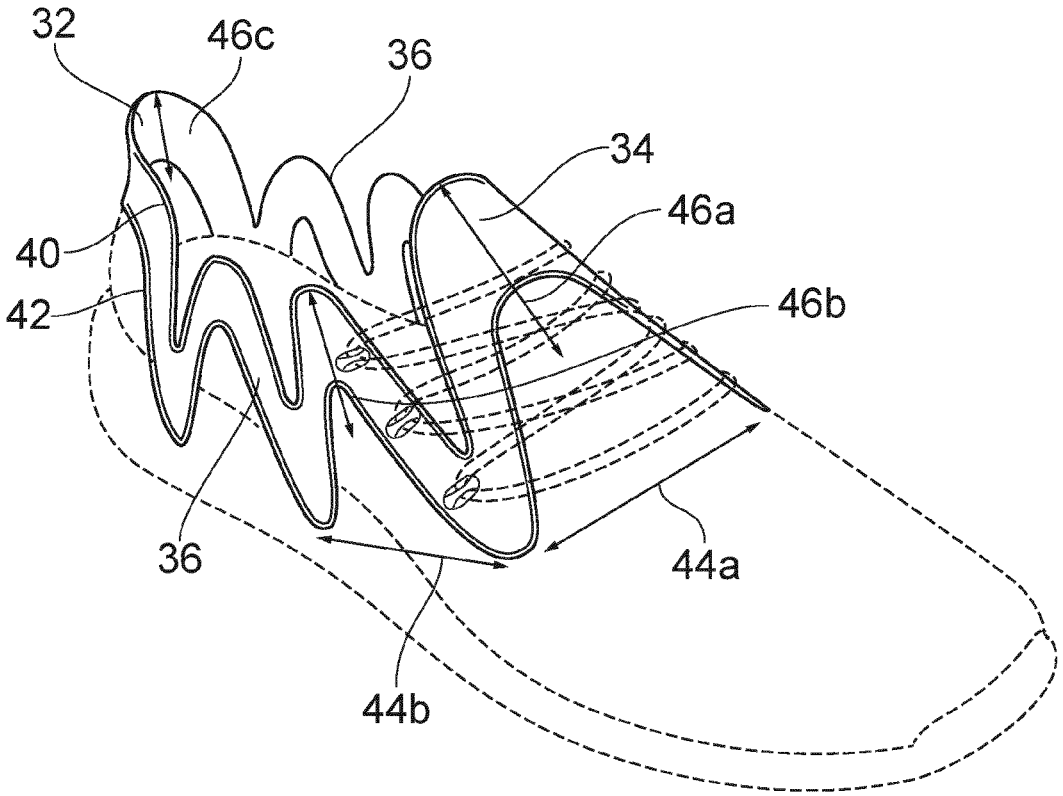
FIG. 5 is a schematic showing an item of footwear comprising a collar according to the three-quarter shoe embodiment.

In the embodiment of FIG. 5, the length 44*a* of the undulation at the tongue region 35 is greater than the length 44*b* of the undulation on the lateral section 36. Similarly, the amplitude 46*a* of the undulation at the tongue region 35 is greater than the amplitude 46*b* at the lateral section 36. The amplitude 46*c* of the undulation at the heel region 33 may be smaller than the amplitude 46*a* of the undulation at the tongue region 35. An angle of the peaks 20 and troughs 22 may also vary around the collar 12.

The greater length 44 and amplitude 46 of the undulations in the heel section 32 and tongue section 34 (compared to the lateral sections 36) provide reduced flexibility in the heel region 33 and tongue region 35 relative to the lateral regions 36, thereby focusing the force exerted on the collar 12 by the wearer's foot to increase the size of the opening 14 to don and doff the footwear 10. The increased thickness 30 of the collar 12 in the heel section 32 and tongue section 34 also contributes to the further focusing of the force exerted on the collar 12 by the wearer's foot.

Figure 4A:
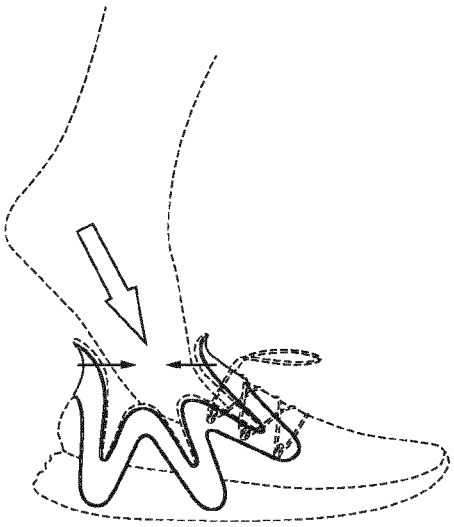
FIGS. 4A to 4E are schematics showing a wearer inserting their foot into the opening of the collar to don and doff the footwear according to the shoe embodiment.
Figure 4B:
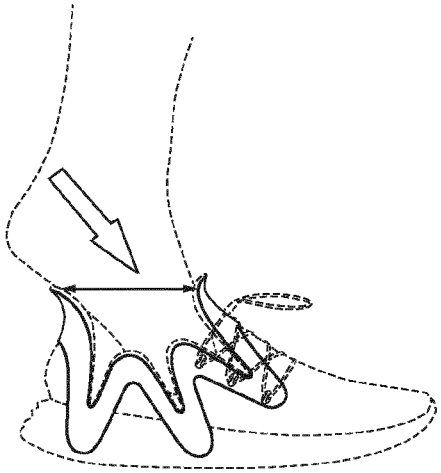
Figure 4C:
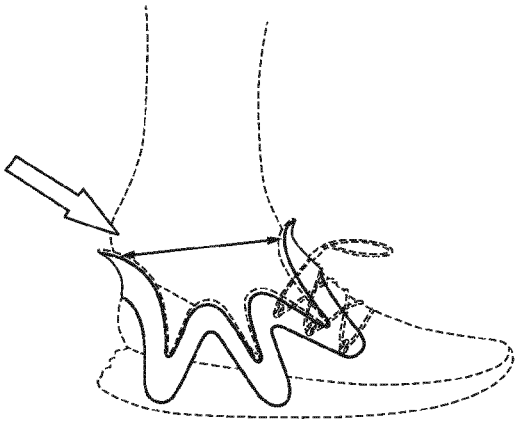
Figure 4D:
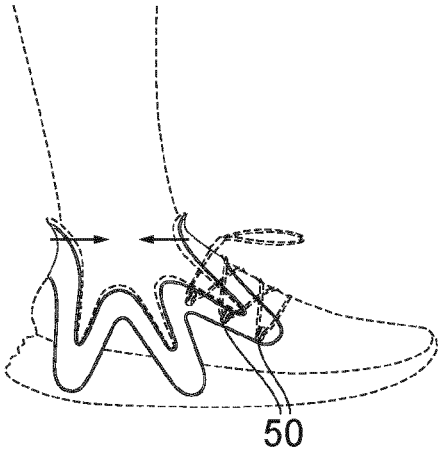
Figure 4E:
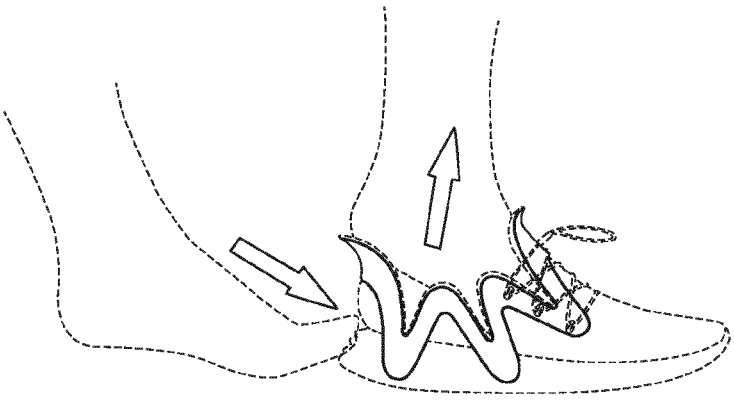

FIGS. 4A to 4E show the mechanism for donning and doffing the item of footwear. The collar 12 can move between a closed configuration (as shown in FIG. 4A) and an open configuration (as shown in FIGS. 4B, 4C and 4E). The collar 12 is configured such that it is biased towards the closed configuration (as shown in FIGS. 4A and 4D), so that the collar 12 in use grasps the wearer's foot. The undulating configuration of the collar 12 causes it to act as a resilient member or spring, flexing into the open configuration when a force is applied and returning to the closed configuration when the force is removed.

As shown in FIGS. 4B and 4C, the collar 12 can be moved into an open configuration in which the size of the opening 14 is increased, for example for the wearer to don and doff the footwear 10. The collar 12 is moved into the open configuration when a wearer's foot is inserted into the opening 14 and exerts a force on the collar 12. Similarly, as shown in FIG. 4E, the collar 12 can be moved into an open configuration in which the size of the opening 14 is increased when a wearer removes their foot from the opening 14, for example by stepping on a heel region 33 of the footwear 10 to hold the footwear 10 in place, thereby to allow the inserted foot's heel and instep to exert a force against the collar 12 and cause the collar 12 to move into the open configuration.

As shown in FIG. 4B, the tongue section 32 and heel section 34 align with the instep and the heel of the wearer's foot, respectively. When donning the item of footwear, the instep of the foot contacts the tongue section 34 of the collar 12 and the heel contacts the heel section 32 of the collar 12. This contact exerts a force on the collar 12 to move the collar 12 to the open configuration.

As shown in FIGS. 4A to 4E the collar 12 is moved to an open configuration when a wearer's foot within the opening 14 exerts a force on the heel section 32 and/or a tongue section 34. In the open configuration, shown in FIGS. 4B and 4C, the heel section 32 and tongue section 24 of the collar 12 are moved further apart compared to the closed configuration, as shown in FIG. 4A.

As shown in FIG. 1, the collar is configured to have peaks at both the heel section 32 and tongue section 34. The tongue section 32 and heel section 34 are both provided with flared portion 37, 38 that flare outwards away from the opening 14. This flared shape increases the size of the opening 14 making it easier for the wearer to insert their foot into the opening 14. Further, the flared shape acts as a lever when the foot presses against it, so that a relatively small force on the flared portion can cause the collar to move into the open configuration. The greater the flared shape the more it can act as a lever due to its greater surface area for the foot to press against. A flared shape having a greater surface area therefore provides an enhanced guide for the inserting foot with more flexing to the collar 12, to aid movement of the collar 12 into the open configuration. The flared shape thereby acts as an integral shoehorn.

The heel section 32 and/or tongue section 34 may each comprise a single peak 20, without a trough 22, as shown in FIG. 1. The flared portion 37, 38 may be located on the single peak 20 at the heel section 32 and/or tongue section 34.

Figure 6:
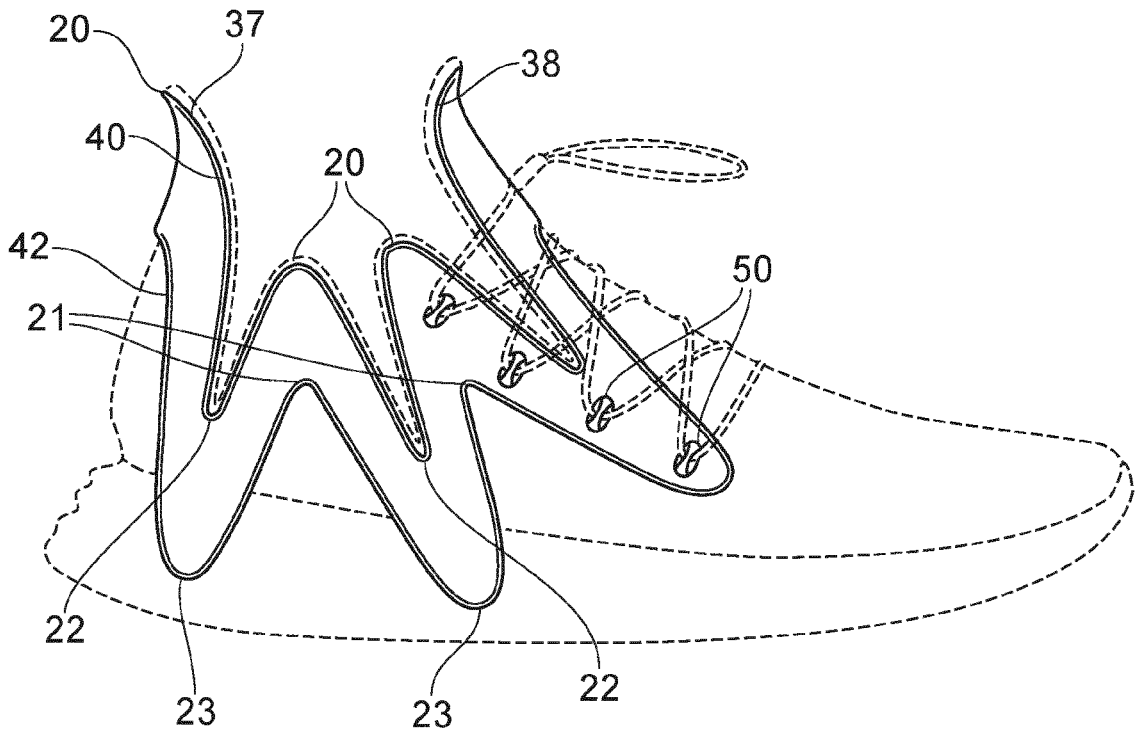
FIG. 6 is a schematic showing an item of footwear comprising a collar according to a boot embodiment.
Figure 9:
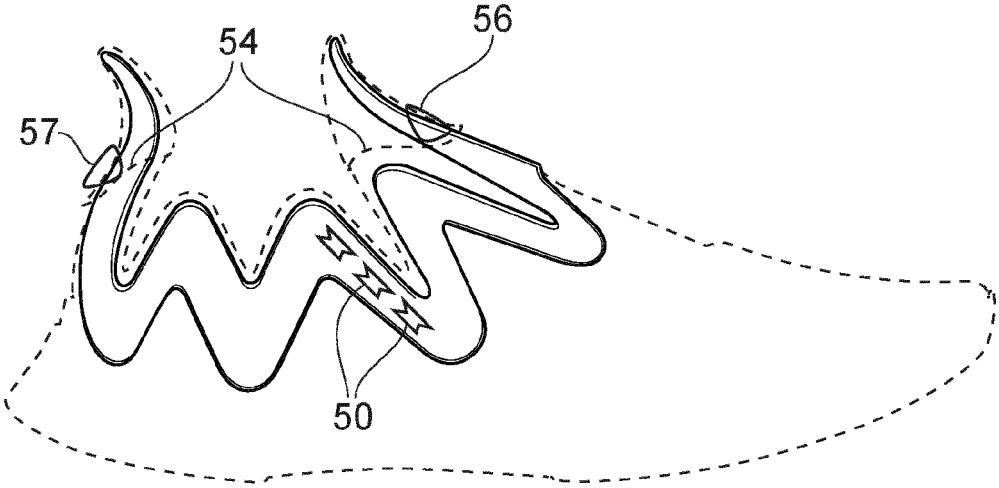
FIG. 9 is a schematic showing an item of footwear comprising a collar according to a further sneaker embodiment.
Figure 13:
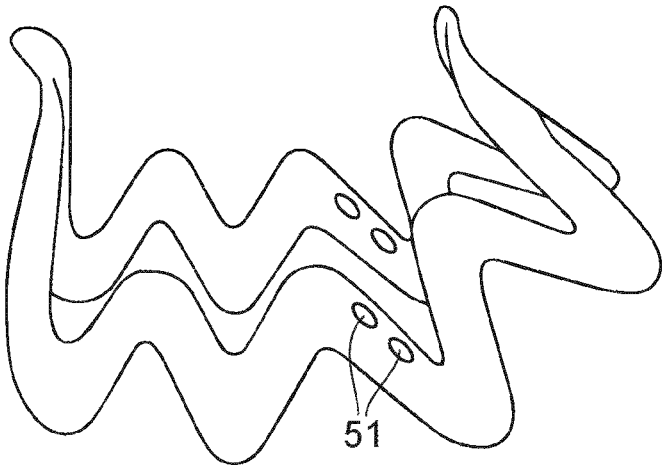
FIG. 13 is a schematic showing a collar according to an embodiment.

The collar may have an integral adjustment means 50, 51 to adjust the fit of the footwear during use or when wearing the footwear 10. Adjustment means are shown in FIGS. 6, 9 and 13. The adjustment means 50, 51 may comprise apertures defined in the material of the collar 12, or comprise a further material affixed to the collar 12. Example adjustment means may be eyelets, hooks or loops. The further material affixed to the collar 12 may be formed of a metal or plastics material. Alternatively, hook and loop fasteners (such as Velcro®) or elastic laces with a toggle may be used to adjust the fit of the footwear 10. For example, elastic laces and a toggle may be used, so that the laces do not need to be re-adjusted to don and/or to doff the footwear 10. The adjustment means 50, 51, such as the apertures, allow laces to be threaded therethrough. The adjustment means 50, 51 may be located in a region adjacent the tongue section 34 of the collar.

As shown in FIG. 13, two apertures 51 are provided in either side of the collar 12 to receive laces therethrough (four apertures in total), thereby to allow the fit of the footwear 10 to be adjusted via tightening or loosening of the laces. The adjustment means 50, 51 are provided closer to the tongue section 34 than the heel section 32 of the collar 12. The adjustment means 50, 51 are provided on the collar 12 so as to be symmetrically positioned about a centre line or axis running from the tongue section 34 to the heel section 32.

FIGS. 5 and 6 show similar arrangements in a three-quarter shoe and boot, respectively. The basic configuration of the collar 12 is similar to the embodiment of FIG. 1, however the shape of the collar 12 will differ slightly as it will contact the wearer's foot at a higher position than the footwear of FIG. 1.

Figure 7:
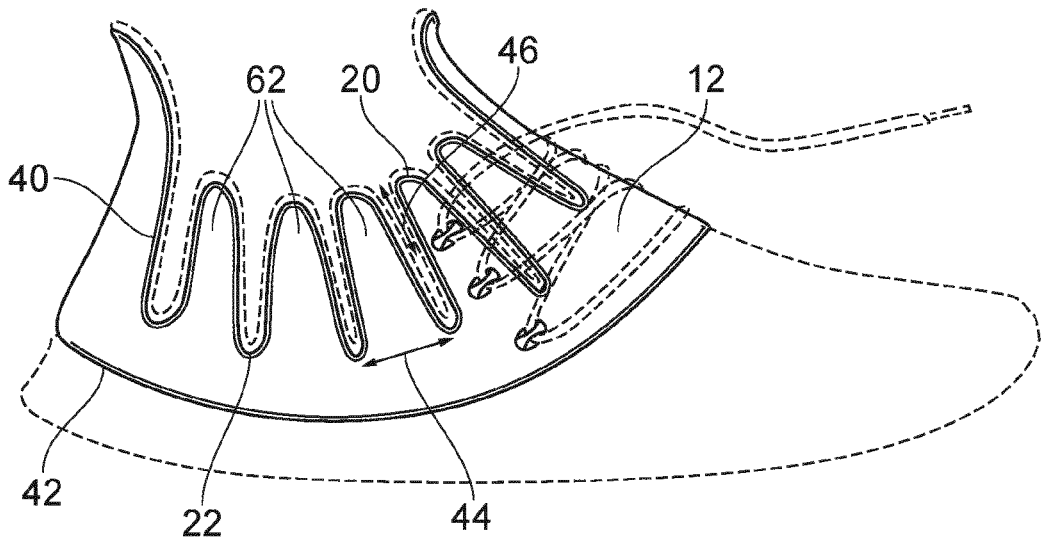
FIG. 7 is a schematic showing an item of footwear comprising a collar according to a fingered-boot embodiment.

The embodiment of FIG. 7 illustrates an item of footwear 10 with a different shaped collar 12. In this embodiment, the upper edge 40 of the collar 12 comprises peaks 20 and troughs 22 but the lower edge does not. In this embodiment, the peaks 20 of the upper edge 40 extend upwards as fingers 62 pointing towards the wearer's leg. In this embodiment, there are twelve peaks 20 and twelve troughs 22 in the collar. As the collar 12 moves from the closed configuration to the open configuration, the gaps between adjacent fingers 62 (i.e., the troughs 22) will increase.

Figure 8:
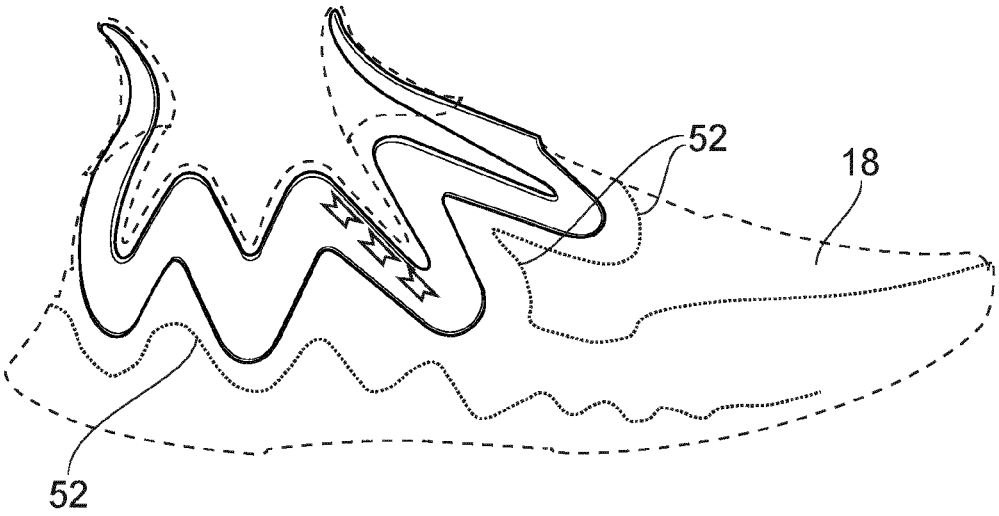
FIG. 8 is a schematic showing an item of footwear comprising a collar according to a sneaker embodiment.

The embodiment of FIGS. 8 and 9 show a sneaker.

In this embodiment, the collar 12 borders the opening 14 in combination with an upper 18 of the footwear 10, so that in the tongue region 35 of the footwear 10, portions of the upper 18 extend above the collar 12. In this embodiment, the collar 12 has eight peaks.

The collar 12 may be removable from the footwear 10, enabling collars 12 to be removed and replaced. This has the advantage that different colours and designs of collars 12 can be selected, for example to match an outfit.

The footwear 10 has a collar-receiving means 52, 54, in the upper and/or sole of the footwear, such that the collar 12 is removably attached to the footwear 10, shown in FIGS. 8 and 9. As shown in FIG. 8, the collar-receiving means 52 comprises a recessed surface or cavity into which the collar 12 is mounted. The edges of the recessed surface may be embossed or comprise protrusions to hold the collar 12 in place. Alternatively, or in combination, as shown in FIG. 9, the collar-receiving means 54 means comprises a pocket into which the collar 12 is insertable. Pockets are located on the tongue region 35 and heel region 33 of the footwear 10, however a single pocket on just one of these regions is sufficient. In use, a peak 20 of the collar 12 extends into the pocket. The pocket may be permanently or removably attached to the footwear 10.

Alternatively, the collar 12 may be permanently bonded to the footwear 10 (i.e., to the upper 18 and/or sole 16 of the footwear 10). The collar 12 may be attached to the footwear 10 via cementing and/or stitching.

When the collar 12 is removably attached to the footwear 10, as shown in FIG. 9, the collar 12 may comprise a first fastening means 56 and the footwear 10 may comprise a second fastening means (not shown), the first fastening means 56 and second fastening means cooperating together to secure the collar 12 in position on the footwear 10. The first fastening means 56 may be in the form of a protrusion which cooperates with the second fastening means in the form of an aperture. In use, the first fastening means 56, for example in the form of a protrusion, is inserted through the aperture. In the embodiments of FIGS. 8 and 9, the first fastening means 56 is located on a tongue section 34 of the collar 12 and the second fastening means (not shown) is located on the tongue region 35 of the footwear (on the pocket in this embodiment). Alternatively, the first fastening means 56 and second fastening means may be positioned at other locations on the collar 12 and footwear, respectively.

As shown in FIG. 9, the collar 12 may comprise a third fastening means 57 and the footwear 10 may comprise a fourth fastening means (not shown), the third fastening means 57 and fourth fastening means cooperating together to secure the collar 12 in position on the footwear 10. The third fastening means 57 may be in the form of a protrusion which cooperates with the fourth fastening means in the form of an aperture. In use, the third fastening means 57, for example in the form of a protrusion, is inserted through the aperture. In the embodiments of FIGS. 8 and 9, the third fastening means 57 is located on a heel section 32 of the collar 12 and the fourth fastening means (not shown) is located on the heel region 33 of the footwear (on the pocket in this embodiment). Alternatively, the third fastening means 57 and fourth fastening means may be positioned at other locations on the collar 12 and footwear, respectively.

In alternative embodiments, the fastening means is not limited to a button and aperture (as described with reference to FIGS. 8 and 9) but may be any other suitable fastening means, for example hook and loop fasteners, or poppers, amongst others.

The first fastening means 56 and third fastening means 57 are located on the tongue section 34 and heel section 32 of the collar 12 respectively. In alternative embodiments, the fastening means may be located at any other suitable location on the collar 12. Similarly, the fastening means may be located at any other suitable corresponding location on the footwear.

In the embodiment of FIG. 9, the first fastening means 56 is a button. In the embodiment of FIG. 9, the third fastening means 56 is a button. The button may have a broad top and a stem, in the shape of a mushroom.

Whilst two sets of fastening means (i.e., at the tongue and heel) have been described above, and shown in FIG. 9, in other embodiments no or yet further fastening means may be provided to tailor the fit of the collar 12 with the footwear 10.

Figure 10:
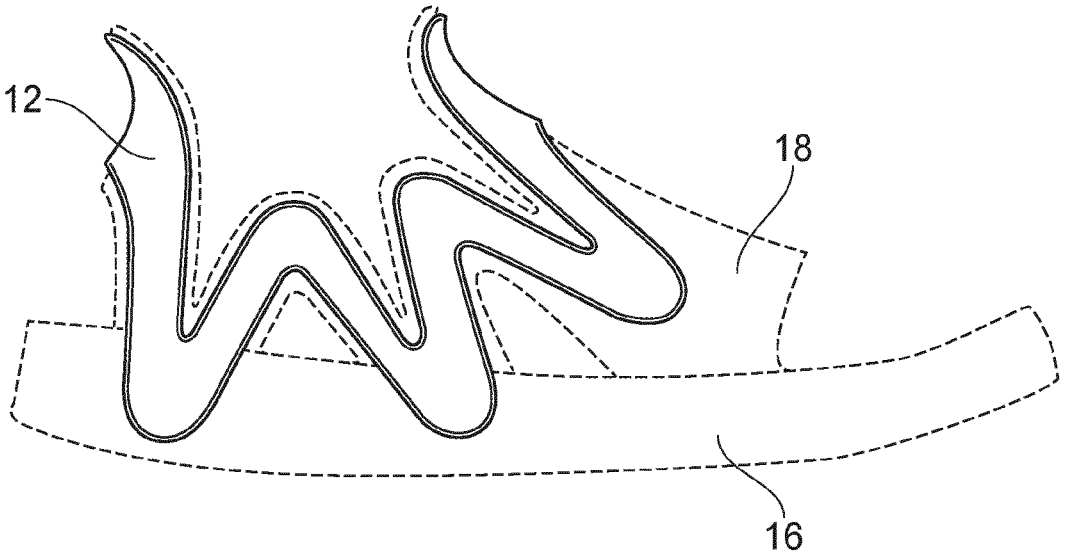
FIG. 10 is a schematic showing an item of footwear comprising a collar according to a slide-sandal embodiment.

The embodiment of FIG. 10 is a sandal, with a collar 12 similar to the embodiment of FIG. 1.

Figure 11:
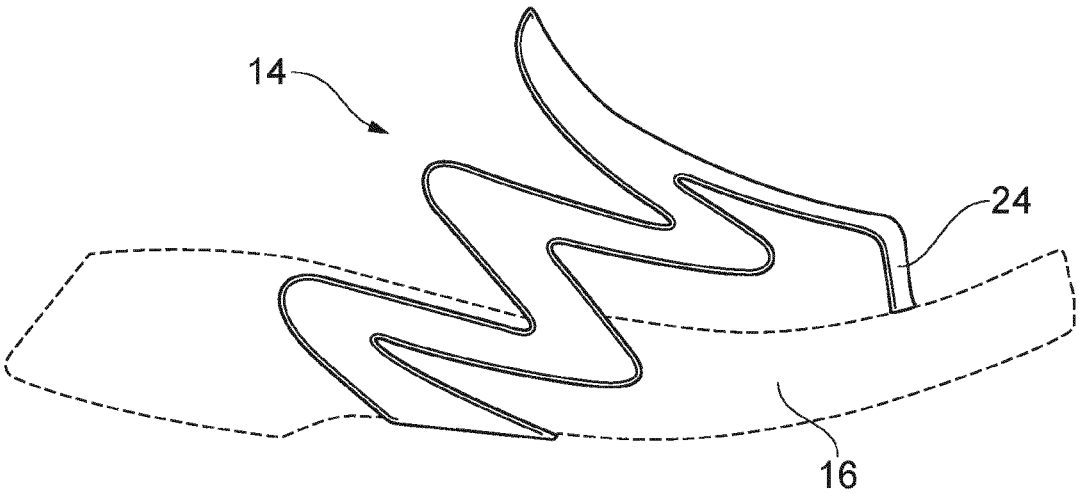
FIG. 11 is a schematic showing an item of footwear comprising a collar according to a further slide-sandal embodiment.
Figure 12A:
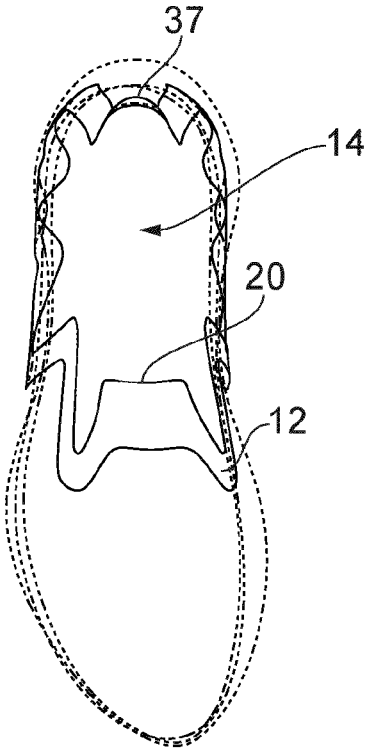
FIGS. 12A to 12D are schematics showing an item of footwear comprising a collar according to a further shoe embodiment.
Figure 12B:
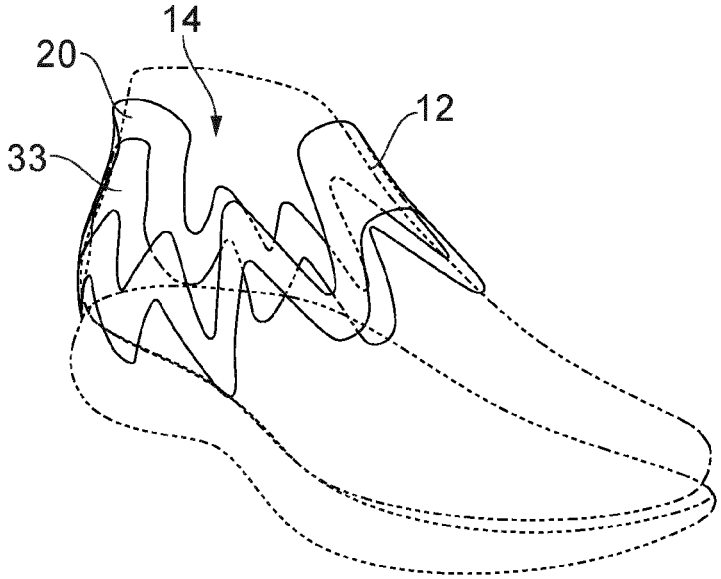
Figure 12C:
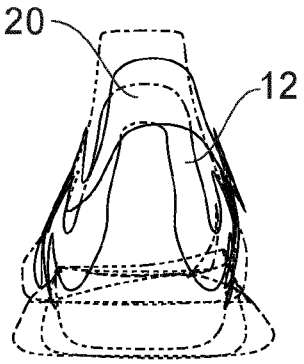
Figure 12D:
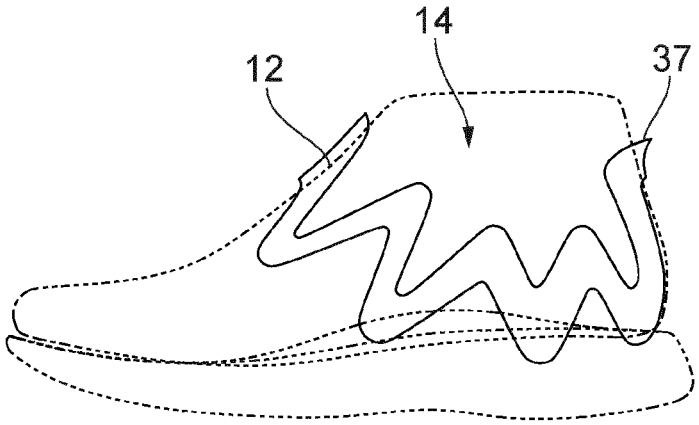

The embodiment of FIG. 11 is also a sandal. In this embodiment, the item of footwear 10 does not have an upper (18) but consists only of the sole 16 and collar 12. In this embodiment, the opening 14 is defined by a combination of the collar 12 and sole 16, with the collar 12 defining 180 degrees of the opening 14. The collar 12 is either attached to the sole 16 at the lateral regions 36 of the sole 16 or the collar 12 is wrapped or passed underneath the sole 16. The collar 12 is provided with an integral toe-post 24, which is located at a toe region 60 of the footwear 10 and attached to the sole 16 at one end. The collar 12 may be insertable into recesses in the sole 16 of the footwear 10. The collar 12 (including toe post 24) may be reversibly attached to the sole 16, enabling the collar 12 to be removed from the footwear 10 and replaced.

The collar 12 has been described herein as having a set number of peaks 20 and troughs 22, however, this is not to be seen as limiting. The collar 12 may comprise any number of peaks 20 and troughs 22.

The adjustment means 50, 51 have been described as located on or towards the tongue section 34 of the collar 12. However, this is not seen to be limiting since the adjustment means may be located at any suitable point around the collar 12 for adjusting the fit of the footwear 10.

The first fastening means 56 have been described as located on a tongue section 34 of the collar 12 and the second fastening means (not shown) located on the tongue region 35 of the footwear. The third fastening means 57 have been described as located on a heel section 32 of the collar 12 and the fourth fastening means (not shown) located on the heel region 33 of the footwear. However, this is not seen to be limiting since the first and/or third fastening means 56, 57 and second and/or fourth fastening means may be located at any point around the collar 12 and/or footwear 10.

The invention claimed is:

1. An item of footwear comprising a sole, a collar, and an opening into which a wearer's foot is insertable, the collar comprising:

a molded one-piece semi-rigid element which borders and thereby defines the opening, by itself or in combination with a sole or an upper of the footwear to continuously surround the opening; and wherein the one-piece semi-rigid element comprises a closed ring with a heel section a tongue section, and lateral sections therebetween to continuously surround the opening and has an undulating configuration comprising a first series of alternating peaks and troughs, the peaks being located adjacent the opening;

wherein the collar is biased into a closed configuration which in use grasps a wearer's foot and can be moved into an open configuration in which the size of the opening is increased to enable the wearer to don and doff the footwear, and wherein the undulating configuration of the collar is configured to cause the collar to act as a resilient member or spring, flexing into the open configuration when a force is exerted on the heel section and/or the tongue section of the element and returning to the closed configuration when the force is removed, thereby biasing the collar into the closed configuration;

wherein the one-piece semi-rigid element is configured such that, in use, the tongue section and heel section respectively align with an instep and a heel of the wearer's foot, such that the instep can contact the tongue section of the collar, and/or the heel can contact the heel section of the collar, to exert the force on the collar and move the collar to the open configuration.

2. An item of footwear according to claim 1, wherein the collar comprises a first face and a second opposed face, the first face configured in use to be adjacent a wearer's foot, and wherein a thickness of the collar is defined between the first face and second opposed face, wherein the thickness varies at different positions of the collar.

3. An item of footwear according to claim 1, wherein the heel section or the tongue section comprises a single peak, configured in use to respectively come into contact with an instep or a heel of the wearer's foot.

4. An item of footwear according to claim 3, wherein when collar is configured such that when the wearer's foot is fully inserted into the footwear, the collar passes over the foot's instep, such that the instep is adjacent a throat region of the footwear.

5. An item of footwear according to claim 3, wherein the heel section or the tongue section comprises a flared portion that flares radially outwards away from the opening to thereby act as a shoehorn.

6. An item of footwear according to claim 3, wherein the collar comprises a first face and a second opposed face, the first face configured in use to be adjacent the wearer's foot, and wherein a thickness of the collar is defined between the first face and second opposed face, wherein the thickness varies at different positions of the collar, and wherein the thickness of the collar is greater at the heel section or the tongue section than the lateral sections.

7. An item of footwear according to claim 1, wherein the collar comprises an upper edge and a lower edge, wherein the upper edge comprises the first series of alternating peaks and troughs, wherein a distance between the upper edge and the lower edge varies around the collar, wherein the undulating configuration further comprises a second series of alternating peaks and troughs and the lower edge comprises the second series of alternating peaks and troughs.

8. An item of footwear according to claim 1, wherein the undulating configuration is selected from the group consisting of: a waveform; a zig-zag; a sinusoid; a concertina shape; a coil shape; fingers, and combinations thereof.

9. An item of footwear according to claim 1, wherein the series of alternating peaks and troughs correspond to multiple undulations of the undulating configuration, each undulation comprising a single peak and trough and having a varying length and/or amplitude around the collar.

10. An item of footwear claim 1, wherein the collar is adjustable.

11. An item of footwear according to claim 1, wherein the collar is removably attachable to the footwear.

12. An item of footwear according to claim 11, comprising a recessed surface into which at least part of the collar is removably mounted in use or a pocket configured to removably receive a portion of the collar.

13. An item of footwear according to claim 12, wherein the pocket is located on a tongue region or a heel region of the footwear.

14. An item of footwear according to claim 1, wherein the collar comprises a first fastener and the footwear comprises a second fastener, wherein the first and second fasteners are configured to interact, in use, to fasten the collar to the footwear and wherein the first fastener is located on a tongue section of the collar and the second fastener is located on a tongue region of the footwear.

15. An item of footwear according to claim 14, wherein the first fastener comprises a protrusion and the second fastener comprises an aperture configured to receive the protrusion.

16. An item of footwear according to claim 14, wherein the collar and footwear each comprise a further fastener configured to interact, in use, to further fasten the collar to the footwear.

17. An item of footwear according to claim 1, wherein the collar substantially surrounds or continuously surrounds the opening through 360 degrees of the opening.

18. A footwear collar for defining an opening into which a wearer's foot is insertable, the collar comprising:

a molded one-piece semi-rigid element comprising a closed ring, configured such that in use it borders the opening of an item of footwear, by itself or in combination with a sole or an upper of a footwear, to continuously surround the opening, the one-piece semi-rigid element comprising a heel section and a tongue section with lateral sections therebetween, and an undulating configuration comprising a first series of alternating peaks and troughs, the peaks being located adjacent the opening wherein the collar is biased into a closed configuration which in use grasps a wearer's foot and can be moved into an open configuration in which the size of the opening is increased to enable the wearer to don and doff the footwear, and wherein the undulating configuration of the collar is configured to cause the collar to act as a resilient member or spring, flexing into the open configuration when a force is exerted on the heel section and/or the tongue section of the element and returning to the closed configuration when the force is removed, thereby biasing the collar into the closed configuration; and wherein the one-piece semi-rigid element is configured such that, in use, the tongue section and heel section respectively align with an instep and a heel of the wearer's foot, such that the instep can contact the tongue section of the collar, and/or the heel can contact the heel section of the collar, to exert the force on the collar and move the collar to the open configuration.

19. A collar according to claim 18, wherein the collar comprises a first face and a second opposed face, the first face configured in use to be adjacent the wearer's foot, and wherein a thickness of the collar is defined between the first face and second opposed face, and wherein the thickness of the collar is greater at the heel section or the tongue section than the lateral sections.

20. An item of footwear according to claim 1, wherein one or more troughs are attached to the sole to restrict movement of the collar.

* * * * *